US006685274B1

(12) United States Patent
Rios et al.

(10) Patent No.: US 6,685,274 B1
(45) Date of Patent: Feb. 3, 2004

(54) METHOD OF MANUFACTURING ONE-PIECE MOP SWAB

(75) Inventors: Esteban Rios, Tijuana (MX); Jaime Topete, Tijuana (MX); William Joseph Mayville, LaSalle (CA)

(73) Assignee: Multi-Reach, Inc., London (CA)

( * ) Notice: Subject to any disclaimer, the term of this patent is extended or adjusted under 35 U.S.C. 154(b) by 0 days.

(21) Appl. No.: 10/014,825

(22) Filed: Oct. 26, 2001

(Under 37 CFR 1.47)

Related U.S. Application Data

(62) Division of application No. 09/490,376, filed on Jan. 24, 2000, now abandoned.

(51) Int. Cl.[7] ..... A47L 13/20
(52) U.S. Cl. ..... 300/21
(58) Field of Search ..... 15/120.1, 120.2, 15/208, 209.1, 228, 229.1, 229.2; 300/16, 21; 428/131, 134–136

(56) References Cited

U.S. PATENT DOCUMENTS 1,384,515 A * 7/1921 Conradson et al. ..... 15/208 X
2,113,431 A * 4/1938 Milliken ..... 15/208 X
2,526,076 A * 10/1950 Jones ..... 15/209.1
3,044,918 A * 7/1962 Wagner ..... 428/135
4,288,884 A * 9/1981 Bahls ..... 428/131 X
4,469,734 A * 9/1984 Minto et al. ..... 428/134
4,608,292 A * 8/1986 Lassen ..... 428/131
4,957,791 A * 9/1990 Richter ..... 428/136 X
5,173,521 A * 12/1992 Ishino ..... 524/45
6,058,552 A * 5/2000 Hanan ..... 15/228
6,161,242 A * 12/2000 Cabrero Gomez et al. ... 15/228 X

FOREIGN PATENT DOCUMENTS

JP 4-146714 * 5/1992 ..... 15/228

* cited by examiner

*Primary Examiner*—Mark Spisich
(74) *Attorney, Agent, or Firm*—Young & Basile, P.C.

(57) ABSTRACT

A method of forming a one-piece mop swab is disclosed, the method comprising: providing at least one continuous, generally planar sheet of absorbent material in which sheet of material are formed a plurality of bounded openings arranged discontinuously in at least first and second directions to define an absorbent surface characterized by a network of seamlessly interconnected absorbent regions of said sheet. The at least one sheet of absorbent material includes lateral edges, the lateral edges of the at least one sheet being joined to define a continuous surface, or belt-like shape, having vertically spaced-apart first and second open ends which may be secured to a selected mop in known fashion.

15 Claims, 5 Drawing Sheets

METHOD OF MANUFACTURING ONE-PIECE MOP SWAB

This application is a divisional of, and claims a benefit of priority from, U.S. patent application Ser. No. 09/490,376, filed Jan. 24, 2000, abandoned.

FIELD OF THE INVENTION

The present invention relates generally to mops, and more particularly to method of forming a one-piece mop swab from at least one continuous, generally planar sheet of absorbent material having a plurality of bounded openings formed therein, the bounded openings arranged discontinuously in at least first and second directions to define an absorbent surface characterized by a network of seamlessly interconnected absorbent regions of the sheet.

BACKGROUND OF THE INVENTION

Mops and mop swabs are well known and have been the subject of numerous improvements over the years. Conventional mop swabs for mops of all varieties have for years been comprised of numerous individual swab elements of a suitably absorbent material, such as yarn, chamois, etc., these individual elements of material being bundled at least at one end and connected to the mop handle to define the desired mop swab shape. The mops disclosed by Yates et al., U.S. Pat. No. 5,060,338, showing a wet mop the swab of which is characterized by a plurality of fibrous strands freely depending from the end of a mop handle, and Monahan, U.S. Pat. No. 5,577,290, showing a self-wringing type mop wherein the strips of material are joined both to an end of a mop handle and a tubular sleeve disposed on the mop handle, are exemplary. Unfortunately, the numerous individual swab elements of the foregoing types of mops are prone to becoming bunched and entangled during mopping and wringing. This yields a mop with an undesirably untidy appearance, and the functionality of which is compromised.

One solution to the foregoing problem has been to interconnect adjacent pairs of individual yarn swab elements about the circumference of the mop swab with ties or other means, such that the swab elements will not tend to become bunched or entangled. The disclosures of Bakemeier, U.S. Pat. No. 2,230,101, and Jumonville, U.S. Pat. No. 1,936,433, are exemplary. Unfortunately, the yarn mops of the Bakemeier and Jumonville patents, while more beneficial than the prior art mop swabs more simply comprising individual, independent mop swab elements, are nevertheless not as economical to manufacture.

It is known to manufacture mop swabs from chamois material. According to one common chamois mop swab configuration, a plurality of generally parallel slits are made in a first direction in a sheet of selected chamois material, the slits defining a plurality of independent, longitudinally continuous swab elements. It is known to make the slits of shorter length than the length of the chamois sheet, such that the swab elements defined therein are secured at their upper and lower ends to a circumferentially continuous marginal edge. This configuration eliminates the need to have to gather the individual swab elements at their ends as is necessary for other prior art mop swab types, particularly those made from individual strands of yarn and the like. However, this prior art type mop swab is still characterized by longitudinal swab elements that are independent of each other along their principal lengths, and which consequently are prone to becoming intertwined during mop use.

Notwithstanding the various improvements in the prior art, there continues to exist the need for a simple and efficient mop swab which can be economically manufactured and which will avoid the problems associated with prior art mop swabs.

SUMMARY OF THE INVENTION

The present invention addresses the problems associated with the prior art, and encompasses other features and advantages, by providing a one-piece mop swab comprising at least one continuous, generally planar sheet of a suitably absorbent material, the material sheet having a plurality of bounded openings therein, the bounded openings arranged discontinuously in at least first and second directions to define an absorbent surface characterized by a network of seamlessly interconnected absorbent regions of the material sheet, so that the mop swab is characterized by the absence of disconnected, independent swab elements capable of becoming bunched and intertwined as is commonplace with numerous prior art mops.

The method of forming the one-piece mop swab of the present invention comprises the following steps:

- providing at least one continuous sheet of absorbent material having lateral edges;
- forming a plurality of bounded openings in the at least one sheet of absorbent material, the bounded openings arranged discontinuously in at least first and second directions to define an absorbent surface characterized by a network of seamlessly interconnected absorbent regions of the material sheet; and
- joining opposing lateral edges of the at least one sheet of absorbent material to define a continuous surface having vertically spaced-apart first and second open ends.

According to one embodiment of this inventive method, the step of forming a plurality of bounded openings in the sheet of absorbent material comprises forming a plurality of generally rhombic bounded openings to define an absorbent surface characterized by a plurality oppositely diagonally oriented absorbent regions seamlessly interconnected in a reticular pattern.

According to another embodiment of this method, the step of forming a plurality of bounded openings in the sheet of absorbent material comprises forming a plurality of slits arranged in approximately parallel rows of discrete slits, and the absorbent surface defined thereby is characterized by approximately parallel continuous rows of absorbent regions oriented in a first direction, the continuous rows of absorbent regions being intermittently seamlessly interconnected to each other.

DESCRIPTION OF THE ILLUSTRATED EMBODIMENT

Figure 1A:
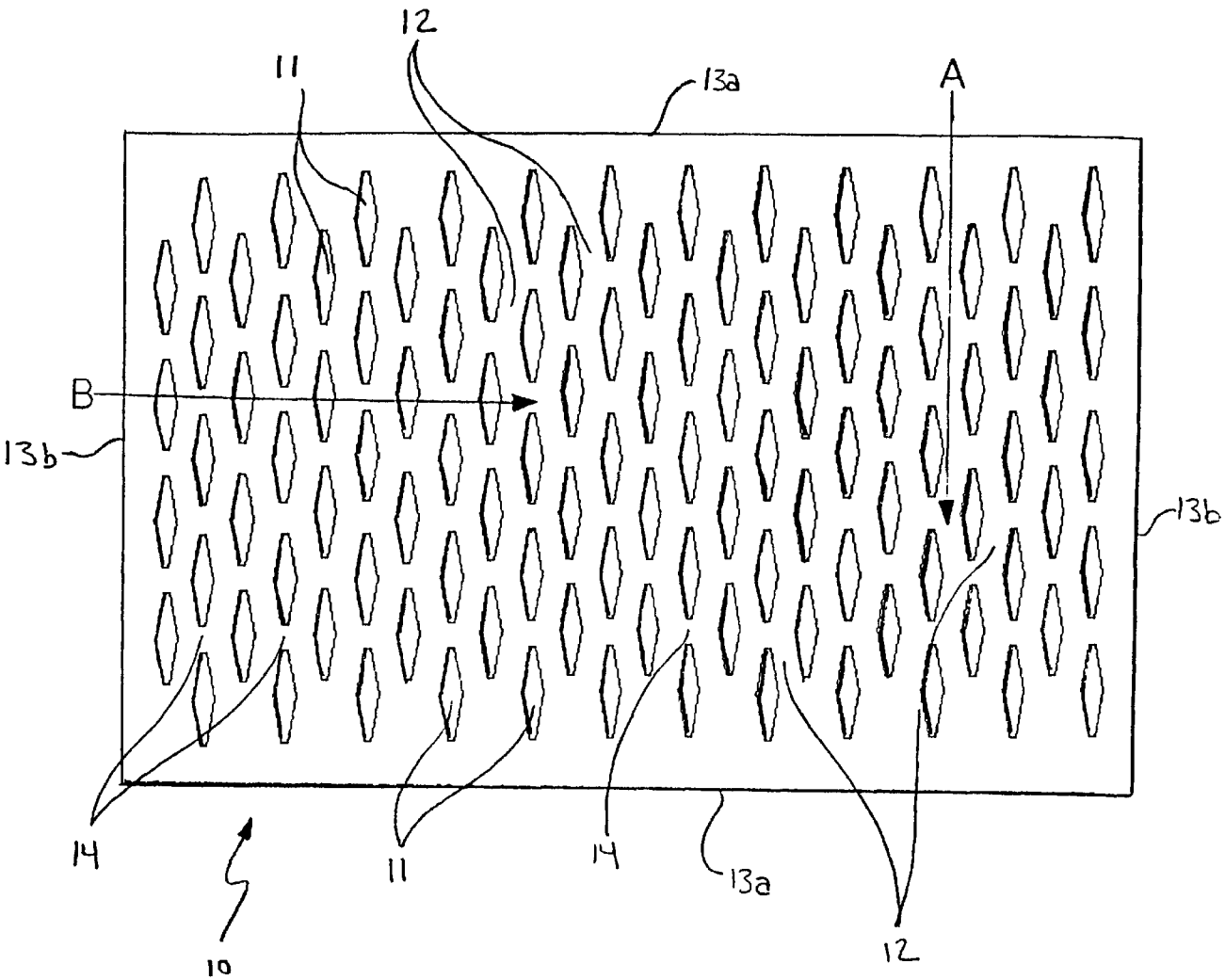
FIG. 1A is an elevational view of one embodiment of the mop swab shown in an unassembled condition.

Referring now to the drawings generally, the improved mop swab and method of manufacture of the present invention is shown and described in combination with a self-wringing mop of the type disclosed in U.S. Pat. No. 5,875,509, the disclosure of which is incorporated herein by reference. This type of mop most basically consists of a mop swab fixed at opposing ends thereof to both one end of a mop handle and to a sleeve rotatably and slidably disposed on the mop handle. By extending the sleeve longitudinally towards an end of the mop handle to which one end of the mop swab is fixed, the mop swab flares radially outwardly so as to function in its normal fashion for mopping. Conversely, moving the sleeve oppositely along the mop handle stretches the mop swab longitudinally so that it may be wrung dry by rotating the sleeve about the longitudinal axis of the handle. However, it will be appreciated from the remainder of the disclosure that the present invention has utility in combination with a wide variety of cleaning implements; and while self-wringing mops specifically are referred to herein for purposes of illustration, the particularized description in this written specification is not meant to be limiting of the scope of this invention as set out in the appended claims.

Figure 1B:
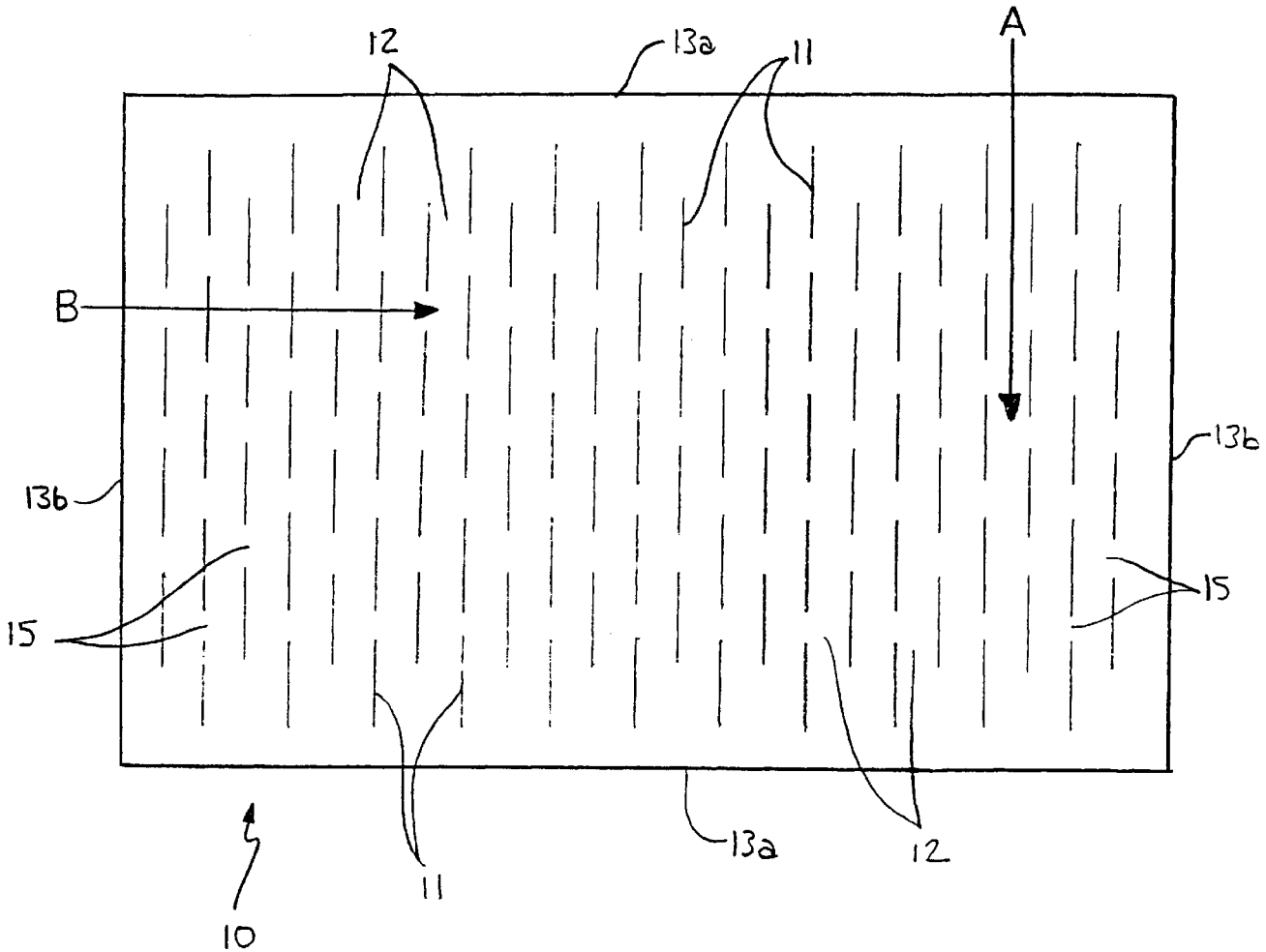
FIG. 1B is an elevational view of an alternate embodiment of the mop swab shown in an unassembled condition.

Turning to FIGS. 1A and 1B particularly, the unassembled mop swab 10 of the present invention most generally comprises at least one generally planar material element comprised of a sheet of suitably absorbent material, the sheet having a plurality of bounded openings 11 made therein and arranged discontinuously in at least first (indicated by the arrow A) and second (indicated by the arrow B) directions to define an absorbent surface characterized by a network of seamlessly interconnected absorbent regions 12 of the sheet.

The material sheet is of a suitably absorbent material, preferably a woven or non-woven fabric of any of the numerous kinds known in the art, including synthetic and natural materials. Though not intended as an exhaustive list, such materials include natural fibers such as cotton and wool, and plastics, such as polyester, polyurethane, or polyether. Most preferably, the mop swab material comprises a non-woven chamois material, which material is increasingly well known for use in the manufacture of mop swabs.

The mop swab 10 preferably comprises at least one continuous sheet of the selected suitably absorbent material, the sheet having opposing pairs of lateral edges 13*a*, 13*b*. Most preferably, the mop swab 10 comprises a single such sheet of the selected material, as illustrated. However, it is also contemplated by this invention that the sheet of the selected material may comprise a plurality of interconnected sheets, for example with their adjacent lateral edges arranged end-to-end or in lapped arrangement, so as to effectively define a unitary, one-piece mop swab wherein each sheet defines an absorbent surface characterized by a network of seamlessly interconnected absorbent regions. In the illustrated embodiments, the material element of the unassembled mop swab 10 is characterized by a parallelogram (e.g., square or rectangular) geometry. However, the geometry of the sheet of selected absorbent material is not meant to be limiting of the present invention, it being understood from the remainder of this specification that the shape of the material will vary according to the needs of the user, including, for example, the type of mop with which the inventive mop swab may be used.

A plurality of bounded openings 11 are defined in the selected material of the unassembled mop swab 10, as by cutting out material or otherwise removing material by other known means (FIG. 1A), or by slitting the material sheet (FIG. 1B). It is also contemplated by this invention that the selected absorbent material could be manufactured to include the bounded openings 11 therein, also according to known methods. The bounded openings 11 serve to increase the surface area, and thus the absorbency of, the mop swab 10, as well as to enhance the deformability of the assembled mop swab 10 as will be understood with reference to the rest of this specification.

Figure 2A:
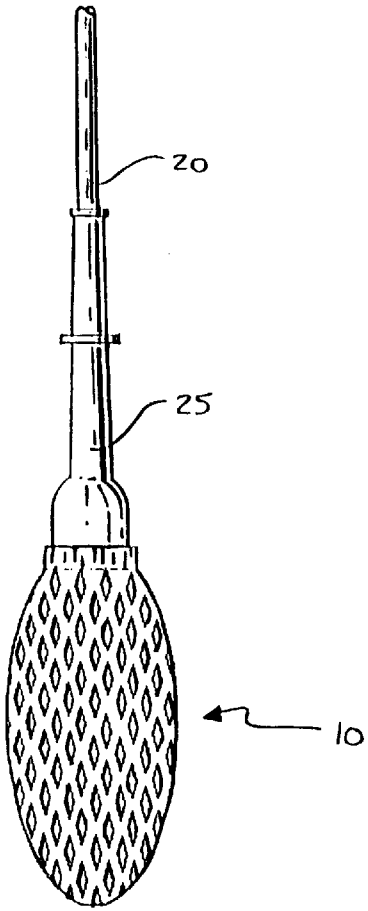
FIG. 2A is an elevational view of the mop swab of FIG. 1A shown in conjunction with a mop of the self-wringing type, and further depicting the mop swab in an extended condition for wringing thereof.
Figure 2B:
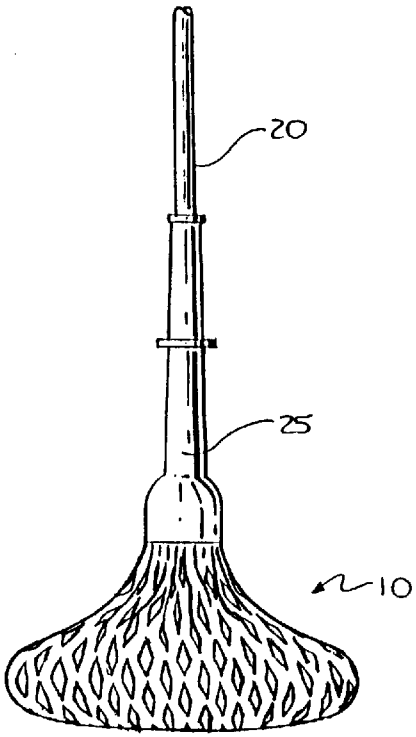
FIG. 2B is an elevational view of the mop swab as shown in FIG. 2A, and further depicting the mop swab in a radially flared condition for mopping.

The bounded openings 11 define an absorbent surface of the material sheet characterized by a plurality of absorbent regions 12 seamlessly interconnected in a network, such that the mop swab 10 is characterized by the absence of disconnected, independent swab elements capable of becoming bunched and intertwined as is commonplace with numerous prior art mops. According to one embodiment, shown in FIG. 1A, the plurality of bounded openings 11 are generally rhombic, and the absorbent surface defined thereby is characterized by a plurality of oppositely diagonally oriented absorbent regions 12 that are seamlessly interconnected (at the locations identified by the reference numeral 14) in a reticular, or net-like, pattern. This preferred arrangement of the openings 11/absorbent regions 12 has particular utility when the mop swab of this invention is used in conjunction with self-wringing type mops, according to which the assembled mop swab 10, defining a generally cylindrical shape, is gathered at its opposing open ends, which ends are secured to the mop handle 20 and sleeve 25 in any suitable manner, all as disclosed, for example, in U.S. Pat. No. 5,875,509. As shown in FIGS. 2A and 2B, when the present inventive mop swab is used in conjunction with a self-wringing type mop, the most preferred reticular pattern yields an assembled mop swab 10 which, when fully extended, assumes a generally cylindrical form suited for wringing the mop swab 10 (FIG. 2A), and which is further capable of being circumferentially deformed so as to define a radially flared shape (FIG. 2B) which is suited for mopping.

It will be appreciated that other configurations of the bounded openings 11 may be adopted subject to the broad purpose of this invention to provide a mop swab characterized by a network of interconnected absorbent regions so as to reduce or eliminate the intertwining so common with conventional mop swabs. Thus, by way of example, it is within the purview of this invention that a plurality of generally square openings could be provided in the selected absorbent material element, the generally square openings defining a plurality of absorbent regions of the material sheet arranged in seamlessly continuous, perpendicularly intersecting rows in a grid-like pattern. Alternatively, for example, the bounded openings could comprise generally rhombic shapes arranged to define a plurality of absorbent regions of the material sheet arranged in seamlessly continuous, oppositely extending diagonal rows intersecting in a lattice pattern.

It will be further appreciated that the bounded openings 11 need not comprise cut-out portions of the material sheet, but may instead, as shown in an alternative embodiment of the invention illustrated in FIG. 1B, comprise slits. According to this embodiment, the slits are arranged in approximately parallel rows of discrete slits, so that the absorbent surface of the material sheet defined thereby is characterized by approximately parallel continuous rows of absorbent regions 12 oriented in a first direction (indicated by the arrow A), the continuous rows of absorbent regions 12 being intermittently seamlessly interconnected to each other between the slits (at the locations identified by the reference numeral 15).

In the most preferred form of this embodiment, the arrangement of slits are staggered in alternating rows as shown. Particularly when the present inventive mop swab is used in conjunction with a self-wringing type mop, this most preferred arrangement of the slits yields an assembled mop swab which, when fully extended, assumes the above-described generally cylindrical form suited for wringing the mop swab, and which is further capable of being circumferentially deformed so as to define the above-described radially flared shape which is suited for mopping.

It will be appreciated that by defining a seamlessly continuously interconnected absorbent regions 12 from the sheet of the selected absorbent material, the mop swab 10 of the present invention is at once economical to manufacture, while being characterized by the absence of individual, disconnected longitudinal swab elements capable of becoming bunched and intertwined as is commonplace with numerous prior art mops.

Figure 3A:
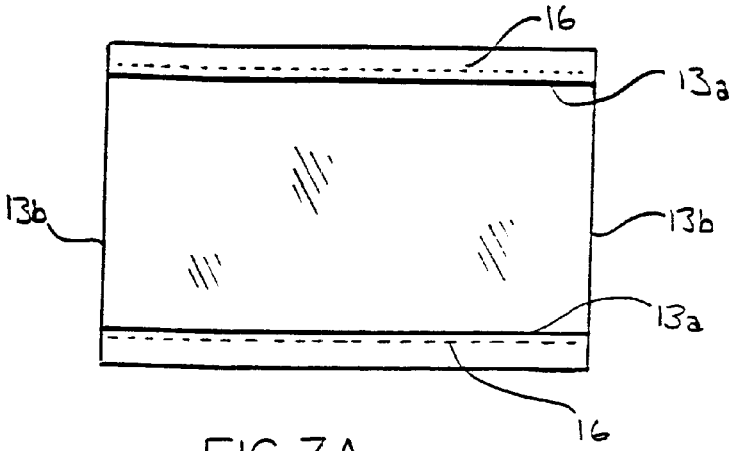
FIGS. 3A–3C depict the method of manufacturing the mop swab of the present invention.
Figure 3B:
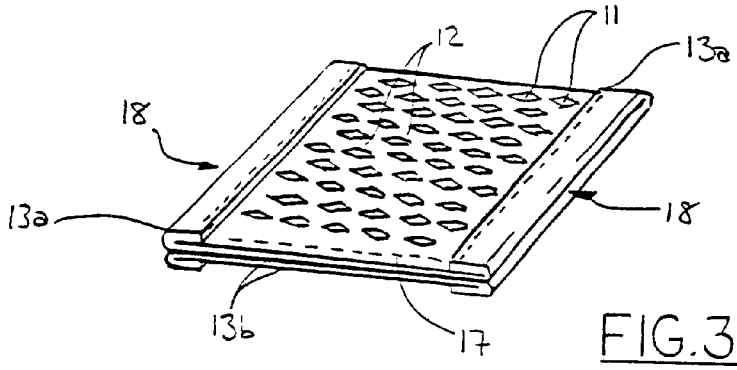
Figure 3C:
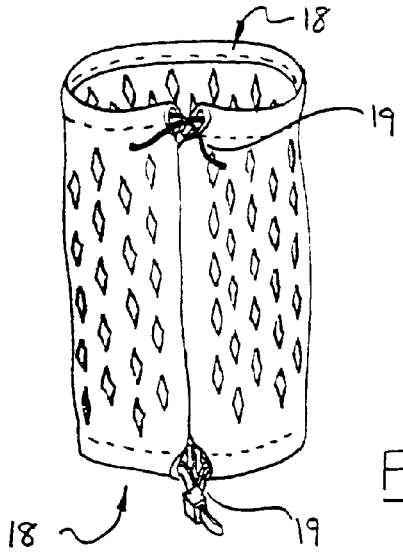

In manufacture of the present inventive mop swab, exemplified in FIGS. 3A–3C, a generally planar sheet of the selected absorbent material, including those materials specified above, is cut to include the plurality of bounded openings 11 in the discontinuous arrangement herein described so as to define the network of seamlessly interconnected absorbent regions 12 of the material sheet. One pair of opposing lateral edges 13*b* of the material sheet are thereafter brought together and joined, for example by sewing along their overlapped length, to define a generally cylindrical shape characterized by a continuous circumferential surface and open ends proximate lateral edges 13*a*. The open ends of the thus assembled mop swab are preferably gathered, for instance as disclosed in U.S. Pat. No. 5,875,509, and secured to the mop as required (for example, by securing one open end of the mop swab to the grip sleeve, and securing the other open end to the mop handle, as disclosed in U.S. Pat. No. 5,875,509).

More particularly, in the preferred method of manufacture a length of a planar sheet of a suitably absorbent material is cut, the dimensions of the material sheet being selected according to the desired dimensions of the assembled mop swab. As previously stated, the material sheet most preferably comprises a single, continuous piece of the selected absorbent material. However, it is also contemplated that the sheet may comprise a plurality of interconnected sheets, for example arranged end-to-end or in lapped arrangement at their adjacent lateral edges 13, so as to effectively define a unitary, one-piece sheet.

A marginal portion of the material sheet is folded inwardly towards the material sheet along each lateral edge 13*a* and lengthwise seams 16 are sewn or otherwise provided along the overlapping material to define passageways for receiving therethrough tie wraps, cord, or other means for gathering the opposite ends of the mop swab. (FIG. 3A.) The material sheet is subsequently folded in half lengthwise so that the lateral edges 13*b* are in lapped relation. (FIG. 3B.) The thus folded material sheet is then introduced to a punch press where the bounded openings 11 are formed simultaneously in both halves of the material sheet. Upon extraction from the punch press (not shown), the lapped lateral edges 13*b* of the material sheet are sewn together at a seam 17 or otherwise connected to define a continuous circumferential surface having open ends 18 proximate the lateral edges 13*a*. The thus assembled mop swab 10 is preferably turned inside out, and the open ends are gathered by tie wraps, cord, or other means (indicated by reference numeral 19) passing through the passageways defined by folding the lateral edges 13*a* in the manner hereinabove described.

According to the example of this specification, by which the inventive mop swab is described in conjunction with a self-wringing type mop, one open end of the mop swab is preferably gathered about the slidable, rotatable sleeve of the mop, while the other open end is gathered and secured to an end of the mop handle, for example by being sandwiched between axially mateable halves of a threaded member as disclosed more particularly in U.S. Pat. No. 5,875,509. However, it will be appreciated by those of skill that the means employed for fastening the disclosed mop swab to a mop are not limiting of the present invention, and may be varied according to user preference or other considerations.

Figure 4:
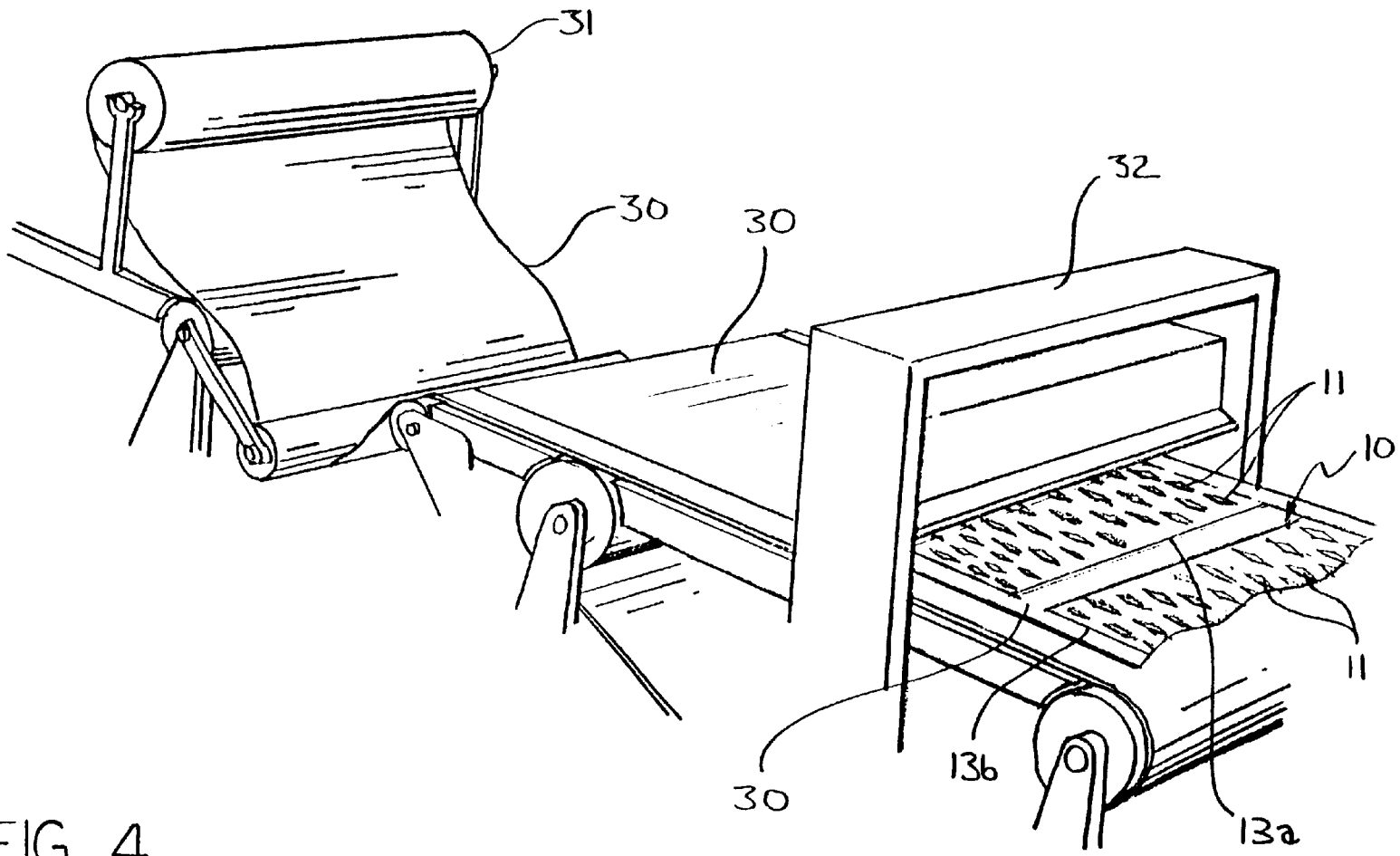
FIG. 4 depicts an alternate embodiment of the method of one means of manufacturing the present inventive mop swab of this invention.

Though a punch press is particularly described above for forming the bounded openings 11 in the material sheet, it is contemplated by this invention that the plurality of bounded openings 11 in the absorbent material sheet of the mop swab may be formed according to numerous methods, all known in the art. For example, the openings 11 may be formed by hand, using scissors or like implements, or by the use of other die-cutting apparatus. The present invention is particularly well-suited to assembly-line formation, and the mop swab thereof may for example be manufactured from a continuous web 30 of the selected suitably absorbent material. (FIG. 4.) According to one embodiment of the inventive method, it is particularly contemplated that such a continuous web 30 of material may be automatically dispensed from a roll 31 of such material and proceed through a die cutter 32 at least operative to automatically cut the desired openings 11 in the material of the unassembled mop 10, all in known fashion. Most preferably, such a die cutter 32 would simultaneously cut such continuous web 30 of selected material to include lateral edges 13*a*, 13*b* defining the desired dimensions of the unassembled mop swab 10. According to this embodiment, the aforedescribed automatic cutting operation could further take place in conjunction with other aspects of manufacturing the present inventive mop swab, such as joining the opposing lateral edges to form the assembled mop swab (not shown), thereby automating entirely the mop swab manufacturing process. Such assembly of the mop swab could of course also take place as a separate operation.

It is further contemplated that the mop swab of the present invention may be manufactured so as to be monolithic, for instance by molding the planar material element in a desired shape and to include the bounded openings therein. Known methods of manufacture, for instance those employed in the creation of non-woven fabrics, could be employed to this end as is known in the art.

Because the present invention comprises a heretofore unknown mop swab of one-piece design wherein the absorbent regions defined by the bounded openings are characterized in being seamlessly interconnected in first and second directions, it will be appreciated that the mop swab resists the entangling to which prior art mop swabs, being comprised of individual, disconnected longitudinal material elements, are prone.

Of course, the foregoing is merely illustrative of one embodiment of the present invention; those of ordinary skill in the art will appreciate that many additions and modifications to the present invention, as set out in this disclosure, are possible without departing from the spirit and broader aspects of this invention as defined in the appended claims.

The invention in which an exclusive property or privilege is claimed is defined as follows:

1. A method of forming a mop swab for use with a mop of the type having an elongate handle with distal and proximal ends, and a sleeve slidingly and rotatably disposed on the handle, the method comprising the steps of:

providing at least one continuous, generally planar sheet of suitably absorbent mop material having opposing lateral edges;

forming a plurality of bounded openings in said at least one sheet of absorbent material, said bounded openings arranged discontinuously in at least first and second directions to define an absorbent surface characterized by a network of seamlessly interconnected absorbent regions of said sheet; and joining opposing lateral edges of said at least one sheet of absorbent material to thereby define a mop swab with a continuous circumferential surface and opposite first and second ends, each of said first and second ends being connectable to one or the other of the handle and sleeve.

2. The method of claim 1, wherein said step of forming a plurality of bounded openings in said sheet of absorbent material comprises forming a plurality of generally rhombic openings to define an absorbent surface characterized by a plurality of oppositely diagonally oriented absorbent regions seamlessly interconnected in a reticular pattern.

3. The method of claim 2, wherein the step of providing at least one continuous, generally planar sheet of suitably absorbent mop material comprises providing a single sheet of said material, said single sheet having opposing lateral edges joined together to define said continuous circumferential surface.

4. The method of claim 1, wherein said step of forming a plurality of bounded openings in said sheet of absorbent material comprises forming a plurality of slits arranged in approximately parallel rows of discrete slits, and said absorbent surface defined thereby is characterized by approximately parallel continuous rows of absorbent regions oriented in a first direction, said continuous rows of absorbent regions being intermittently seamlessly interconnected to each other.

5. A method of forming a mop, comprising the steps of:

providing at least one continuous, generally planar sheet of absorbent material having opposing lateral edges;

providing a handle having opposing ends, and a sleeve rotatably and slidably disposed on the handle;

forming a plurality of bounded openings in said at least one sheet of absorbent material, said bounded openings arranged discontinuously in at least first and second directions to define an absorbent surface characterized by a network of seamlessly interconnected absorbent regions of said sheet;

joining opposing lateral edges of said at least one sheet of absorbent material to thereby define a mop swab with a continuous circumferential surface having spaced-apart first and second ends; and securing one of the first and second ends of the mop swab to an end of the handle, and securing the other of the first and second ends of the mop swab to the sleeve.

6. The method of claim 5, wherein the step of forming a plurality of bounded openings in said sheet of absorbent material comprises forming a plurality of generally rhombic openings to define an absorbent surface characterized by a plurality of oppositely diagonally oriented absorbent regions seamlessly interconnected in a reticular pattern.

7. The method of claim 5, wherein the step of forming a plurality of bounded openings in said sheet of absorbent material comprises forming a plurality of slits arranged in approximately parallel rows of discrete slits, and said absorbent surface defined thereby is characterized by approximately parallel continuous rows of absorbent regions oriented in a first direction, said continuous rows of absorbent regions being intermittently seamlessly interconnected to each other.

8. The method of claim 5, wherein the step of providing at least one continuous, generally planar sheet of suitably absorbent mop material comprises providing a single sheet of said material, said single sheet having opposing lateral edges joined together to define said continuous circumferential surface.

9. A method of forming a one piece mop swab, comprising the steps of:

providing at least one continuous, generally planar sheet of absorbent material having opposing lateral edges;

forming passageways proximate each of a first pair of the opposing lateral edges of said at least one sheet of absorbent material, the passageways dimensioned to receive means for gathering the ends of the mop swab;

forming a plurality of bounded openings in said at least one sheet of absorbent material, said bounded openings arranged discontinuously in at least first and second directions to define an absorbent surface characterized by a network of seamlessly interconnected absorbent regions of said sheet; and joining a second pair of the opposing lateral edges of said at least one sheet of absorbent material to thereby define a mop swab with a continuous circumferential surface having vertically spaced-apart first and second open ends.

10. The method of claim 9, wherein the step of forming passageways comprises folding a marginal portion of said at least one absorbent sheet of material proximate each of the first pair of opposing lateral edges thereof, and securing each of the folded marginal portions to the remainder of the at least one absorbent sheet to thereby define the passageways.

11. The method of claim 9, wherein the step of forming a plurality of bounded openings in said sheet of absorbent material comprises forming a plurality of generally rhombic openings to define an absorbent surface characterized by a plurality of oppositely diagonally oriented absorbent regions seamlessly interconnected in a reticular pattern.

12. The method of claim 11, wherein the step of forming passageways comprises folding a marginal portion of said at least one absorbent sheet of material proximate each of the first pair of opposing lateral edges thereof, and securing each of the folded marginal portions to the remainder of the at least one absorbent sheet to thereby define the passageways.

13. The method of claim 9, wherein the step of forming a plurality of bounded openings in said sheet of absorbent material comprises forming a plurality of slits arranged in approximately parallel rows of discrete slits, and said absorbent surface defined thereby is characterized by approximately parallel continuous rows of absorbent regions oriented in a first direction, said continuous rows of absorbent regions being intermittently seamlessly interconnected to each other.

14. The method of claim 13, wherein the step of forming passageways comprises folding a marginal portion of said at least one absorbent sheet of material proximate each of the first pair of opposing lateral edges thereof, and securing each of the folded marginal portions to the remainder of the at least one absorbent sheet to thereby define the passageways.

15. The method of claim 9, wherein the step of providing at least one continuous, generally planar sheet of suitably absorbent mop material comprises providing a single sheet of said material, said single sheet having opposing lateral edges joined together to define said continuous circumferential surface.

* * * * *

UNITED STATES PATENT AND TRADEMARK OFFICE

CERTIFICATE OF CORRECTION

PATENT NO. : 6,685,274 B1
DATED : February 3, 2004
INVENTOR(S) : Rios et al.

It is certified that error appears in the above-identified patent and that said Letters Patent is hereby corrected as shown below:

Column 8,
Line 10, please delete “one piece”;
Line 28, please delete “open”.

Signed and Sealed this

Thirtieth Day of March, 2004

JON W. DUDAS
*Acting Director of the United States Patent and Trademark Office*